US005465484A

United States Patent [19]

Banks et al.

[11] Patent Number: 5,465,484

[45] **Date of Patent: * Nov. 14, 1995**

[54] HEAT EXCHANGER

[75] Inventors: Simon A. Banks; Colin I. Adderley, both of Derby; John O. Fowler, Lancashire; James E. Boardman, Barnoldswick, all of England

[73] Assignees: Rolls-Royce plc, London; Rolls-Royce and Associates, Derby, both of England

[ * ] Notice: The portion of the term of this patent subsequent to Jan. 24, 2012, has been disclaimed.

[21] Appl. No.: 323,800

[22] Filed: Oct. 17, 1994

Related U.S. Application Data

[62] Division of Ser. No. 98,408, Aug. 4, 1993, Pat. No. 5,383, 518.

[30] Foreign Application Priority Data

Feb. 27, 1991 [GB] United Kingdom ..... 9104155

[51] Int. Cl.[6] ..... B21D 53/04

[52] U.S. Cl. ..... 29/890.042; 165/166

[58] Field of Search ..... 29/890.042; 165/166, 165/167, 170

[56] References Cited

U.S. PATENT DOCUMENTS

| | | | |
|---|---|---|---|
| 3,512,238 | 5/1970 | Canon et al. . | |
| 3,927,817 | 12/1975 | Hamilton et al. . | |
| 4,484,623 | 11/1984 | Rowe et al. . | |
| 4,603,460 | 8/1986 | Yano et al. . | |
| 4,820,355 | 4/1989 | Bampton . | |
| 5,070,607 | 12/1991 | Boardman et al. | 29/890.042 |
| 5,383,518 | 1/1995 | Banks et al. | 165/166 |

FOREIGN PATENT DOCUMENTS

| | | |
|---|---|---|
| 1495655 | 12/1977 | United Kingdom . |
| 1541241 | 2/1979 | United Kingdom . |
| 2067532 | 7/1981 | United Kingdom . |
| 2124520 | 2/1984 | United Kingdom . |
| 2162302 | 1/1986 | United Kingdom . |
| 2218794 | 11/1989 | United Kingdom . |

*Primary Examiner*—Allen J. Flanigan
*Attorney, Agent, or Firm*—Cushman Darby & Cushman

[57] ABSTRACT

A plate-fin type of heat exchanger (100) facilitates exchange of heat between two or more process streams (101, 102). It comprises a matrix (M) of two different types of heat exchange plate elements (P1, P2) inter-digitated with each other. Adjacent plate elements are metallurgically bonded together for good thermal contact by an activated diffusion bonding process. The plate elements (P1, P2) are high-integrity diffusion bonded sandwich constructions comprising two outer sheets (201, 203— FIG. 4) and a superplastically expanded core sheet structure (202) between the two outer sheets. The sandwich construction provides flow passages (P) for the process streams. Adjacent plate elements (P1, P2) carry different process streams (102, 102).

4 Claims, 3 Drawing Sheets

HEAT EXCHANGER

This is a division of application Ser. No. 8/098,408, filed Aug. 4, 1993 U.S. Pat. No. 5,383,518.

This invention relates to heat exchangers of the kind generally known as plate-fin heat exchangers.

The fluid passages in plate-fin heat exchangers are defined by partitions of a metal which has a satisfactorily high coefficient of heat transfer, so that when a high temperature fluid is passed through some passages and low temperature fluid is passed through further passages which are adjacent thereto, there results a cooling of the originally high temperature fluid, by heat conduction through the thickness of the partitions into the cool fluid. Efficiency of heat exchange is boosted by inclusion in the fluid flow passages of so-called "fins", which may in fact be corrugated members, dimples, grooves, protuberances, baffles or other turbulence promoters, instead of fins as such.

Plate-fin heat exchangers offer significant advantages over shell-tube heat exchangers in terms of weight, space, thermal efficiency and the ability to handle several process streams—i.e. several streams of heat exchange media—at once. However, most current plate-fin heat exchanger technology is centred on a brazed matrix construction using aluminium components and is therefore limited to low pressure and low temperature operation. Even using other materials, such as stainless steel, operational pressure limits (say, 80–90 bar) apply because of the use of brazing as the method of fabrication.

Our prior patent applications EP90308923.3 and GB9012618.6 disclose alternative ways of manufacturing plate-fin heat exchanger elements which help to avoid the above problems and allow greater flexibility in their design. Among other things, they describe a method of manufacturing heat exchange plate elements in which metal (e.g. titanium or stainless steel) sheets are stacked together and selectively diffusion bonded to each other before being superplastically deformed to a final hollow shape defining internal passages, which can incorporate integrally formed "fins". Use of superplastic deformation the manufacturing process enables the generation of high volume fractions of hollowness in a heat exchanger element. For example, if titanium sheets are used as the starting point, the result is a high integrity, low weight heat exchanger element which can operate at internal pressures in excess of 200 bar and at temperatures up to 300° C. Stainless steel elements will operate at higher temperatures and pressures.

One object of the present invention is to facilitate easy manufacture and assembly of heat exchangers incorporating matrices of such superplastically formed/diffusion bonded heat exchanger plate elements.

A further object is to provide very high integrity matrices of such plate elements.

According to the present invention, a plate-fin type of heat exchanger for facilitating exchange of heat between at least two process streams, comprises;

a matrix of heat exchange plate elements arranged in side-by-side heat exchange relationship, the plate elements comprising diffusion bonded sandwich constructions, each such sandwich construction having two outer sheets and a superplastically expanded core sheet structure between the two outer sheets, each core sheet structure providing flow passage means for at least one process stream, adjacent plate elements being in intimate thermal contact with each other over at least most of the areas of their side faces through bonded joints between them, and process stream inlet and outlet manifold means integral with the matrix for passing the process streams through the plate elements, the manifold means penetrating the matrix from side-to-side through the thicknesses of the plate elements.

Preferably, for maximum strength and heat and corrosion resistance of the heat exchanger matrix, the bonded joints between adjacent plate elements are metallurgically bonded joints, especially diffusion bonded or activated diffusion bonded joints. If activated diffusion bonded joints are utilised, they are preferably protected from contact with aggressive process stream fluid in the manifold means by autogenous seal welds spanning the joints between the penetrated plate elements.

Further aspects of the invention will be apparent from a reading of the following description and claims.

An exemplary embodiment of the present invention will now be described with reference to the accompanying drawings, in which.

Superplastic forming, diffusion bonding and activated diffusion bonding are well known metallurgical phenomena.

Superplasticity is a deformation phenomenon which allows some materials to strain by large amounts without the initiation of tensile instability or necking. This enables the generation of high volume fractions of hollowness in a heat exchanger matrix, while allowing designs of good mechanical and thermal performance, together with low weight and high utilisation of material.

Diffusion bonding is a solid state metal interface phenomenon in which, provided clean metal surfaces at a suitable temperature are protected from surface contamination by the provision of a suitable joint face environment, and sufficient pressure is applied to the mating surfaces, then solid state diffusion of the metal atoms across the boundary takes place to such an extent that subsequently no interface can be detected. No macroscopic deformation takes place during bonding and therefore shape and size stability is maintained during the operation. Furthermore, the joint produced has parent metal properties without the presence of a heat affected zone or other material such as a flux or bond promoter. Its use within a heat exchanger therefore reduces the possibility of chemical interaction with process fluids.

Activated diffusion bonding differs from diffusion bonding in that the faces of the metal components to be joined are coated with an activator which, at the temperatures and pressures used to achieve the joint, becomes liquid and promotes diffusion of atoms across the interface between the components. The activator is a metal alloy of lower melting point than the metal of which the components are made, but metallurgically related thereto. As a consequence of the differing metallurgical composition of the joint relative to the parent metal on each side, activated diffusion bonded joints, unlike solid state diffusion bonded joints, do not exhibit parent metal properties with respect to stress and corrosion resistance.

Figure 1:
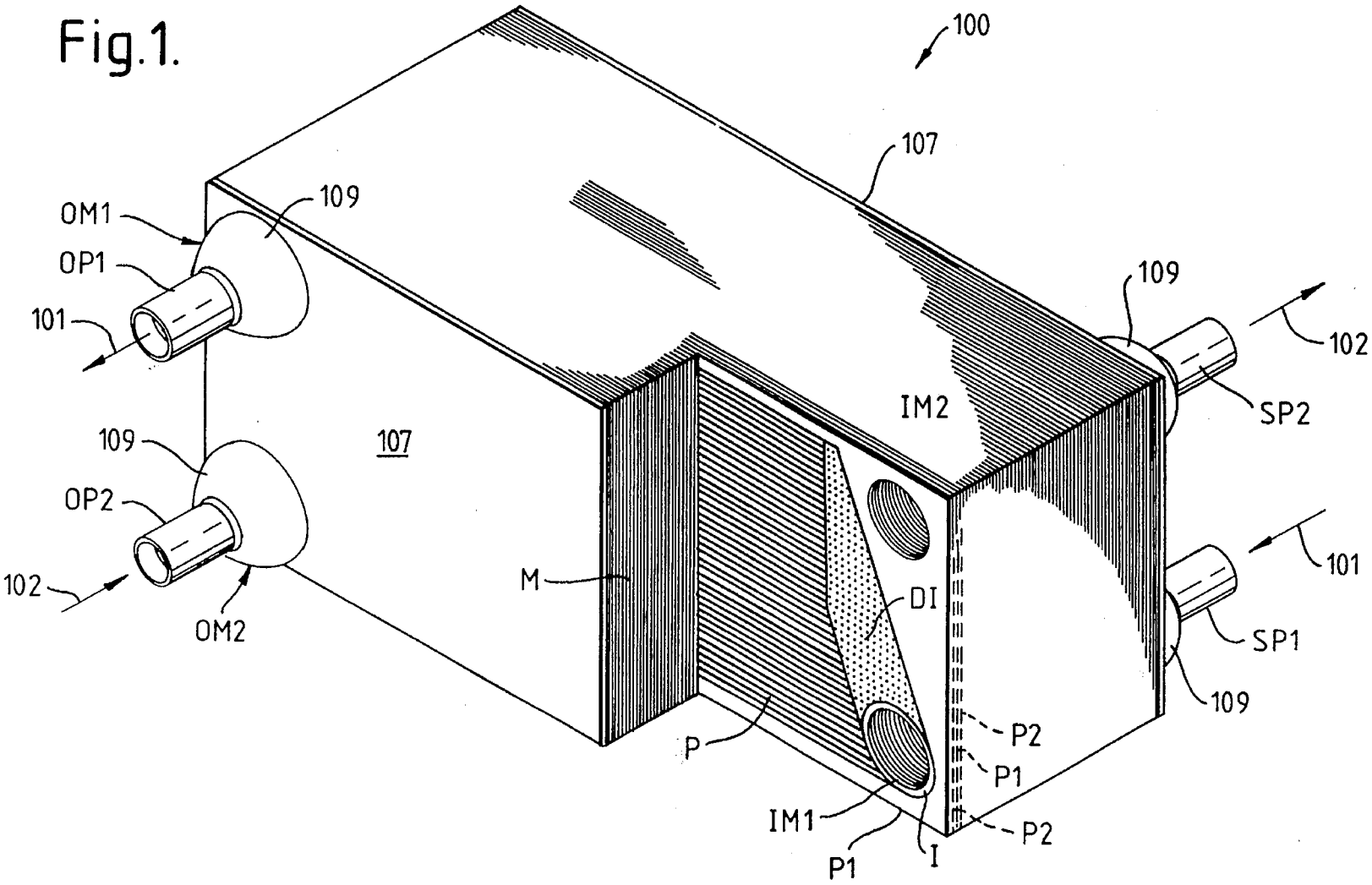
FIG. 1 is a part-sectional view of a complete heat exchanger according to the invention.

Referring to FIG. 1, there is shown a plate-fin type of heat exchanger 100 for facilitating exchange of heat between two counterflowing process streams, 101,102. The heat exchanger matrix M comprises a stack of two types of plate elements P1,P2 which are inter-digitated with each other and whose side faces are metallurgically bonded to each other so that they are in intimate thermal contact with each other over at least most of the areas of their side faces through the metallurgically bonded joints between them. Intimate thermal contact may be defined as that contact which ensures substantially unhindered flow of heat between adjacent heat exchange elements, i.e., compared with the material of which the elements are made, thermal conductivity does not reduce significantly at the interfaces between the elements.

For reasons of structural strength and integrity in the heat exchanger matrix, we have chosen in the present embodiment to achieve the necessary intimate thermal contact between adjacent heat exchange elements by means of metallurgically bonded joints specifically diffusion bonded joints. Nevertheless, it would alternatively be possible to utilise other suitable bonding means, such as brazing, to achieve intimate thermal contact between the elements, provided that the matrix structure so achieved was sufficiently strong, with sufficient heat and corrosion resistance, to be useful for the duty envisaged. Here, a bonding means capable of achieving intimate thermal contact can be defined as a good thermal conductor which, when introduced between the elements under appropriate manufacturing conditions, obviates the surface asperities of the surfaces to be brought into thermal contact with each other.

Plate elements P1 are intended to have process stream 101 flowing through them and plate elements P2 are intended to have process stream 102 flowing through them. Whereas the plate elements P1,P2, etc., in the middle of the matrix stack M are all of the same gauge of titanium alloy in the present example, the front and back end elements of the matrix are manufactured with a thicker sheet on one side to form side plates 107 to which nozzles and supports may be welded.

The heat exchanger matrix M is provided with inlet and outlet manifolds IM1,OM1,IM2,OM2 for supplying the plate elements P1,P2 with the process streams 101,102 respectively. The manifolds are integral with the matrix, and the plate elements constituting it, and penetrate it from side-to-side through the thicknesses of the plate elements. Supply pipes SP1,SP2 and outlet pipes OP1,OP2 carry the process streams 101,102 to and from the heat exchanger. Because the end elements of the matrix M are manufactured with relatively thick outer sheets forming the side plates 107, these pipes can be securely fixed to the heat exchanger through the hemispherical supports 109, which are welded to the side plates 107.

Although hemispherical supports 109 are shown in FIG. 1 as supports for the pipes, they are not invariably a necessary part of the construction. In most cases, the ends of the pipes or nozzles OP1, OP2, SP1, SP2 can be welded directly to the side plates 107.

In the present embodiment the plate elements P1,P2 are of superplastically formable titanium alloy, but other superplastically formable materials such as stainless steel and aluminium alloys may be used, depending on the duty for which the heat exchanger is intended.

The plate elements P1,P2 comprise diffusion bonded sandwich constructions, each such sandwich construction having two outer sheets and a superplastically expanded core sheen structure between the two outer sheets. This construction of the plate elements will now be further described with reference to FIGS. 2A to 2C and 3 as well as FIG. 1.

The heat exchanger plate elements are manufactured by a superplastic forming/diffusion bonding process which will first be briefly described in a simplified manner with reference to FIG. 2. For fuller details of manufacture, reference should be made to our earlier patent applications EP90308923.3 and GB9012618.6.

Figure 2A:
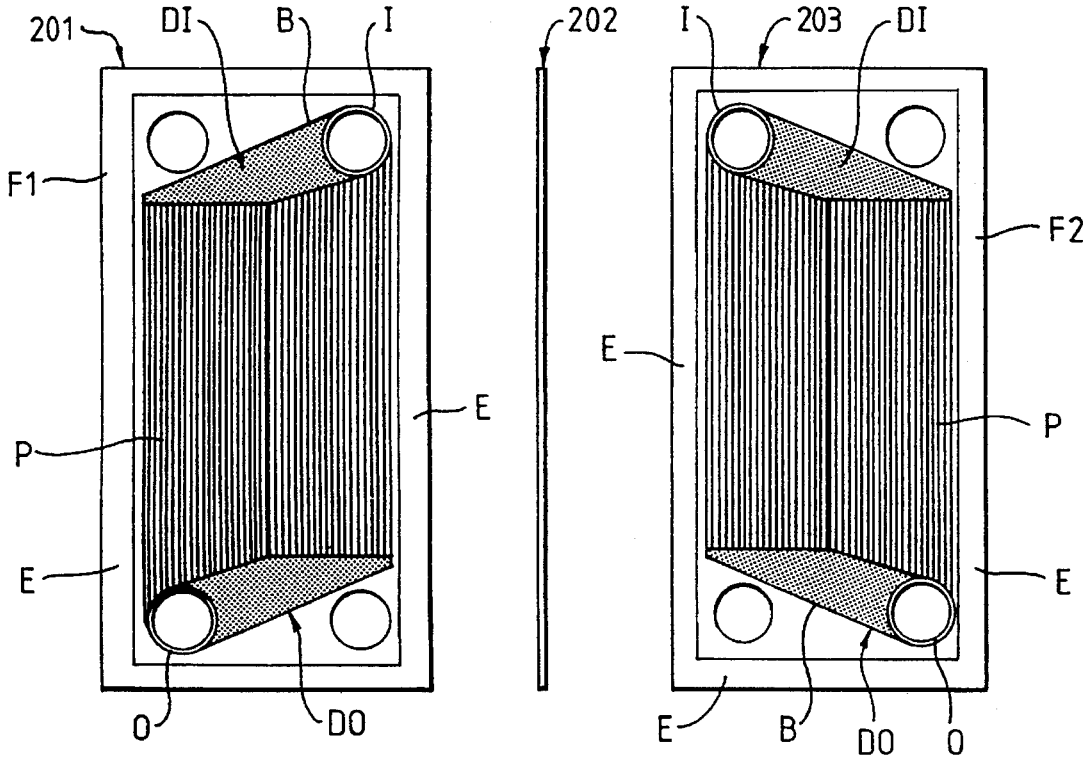
FIGS. 2A to 2C illustrate a process for manufacturing a heat exchanger plate element suitable for use in the present invention.

Referring to FIG. 2A, three superplastically formable metal sheets 201,202,203 (made of, say, a suitable titanium alloy), of near net shape and controlled surface finish, are cleaned to a high standard and a bond inhibitor is deposited onto selected areas of the joint faces F1,F2 of the two outer sheets 201,203. Within boundary B, white areas indicate where the bond inhibitor is deposited, but outside boundary B, no bond inhibitor is deposited. The deposit specifies the ultimate internal configuration of the finished heat exchanger plate element, and comprises areas defining process stream inlets I and outlets O, inlet and outlet flow distributor regions DI and DO respectively, and flow passages P within the element. Edge regions E of the sheets 201,203, where it is not desired to produce an internal structure, do not have any bend inhibitor applied.

Although the internal geometry is fixed at this stage, the deposition process, e.g. silk screen printing, allows considerable flexibility of design to satisfy both mechanical and thermal requirements.

Figure 2B:
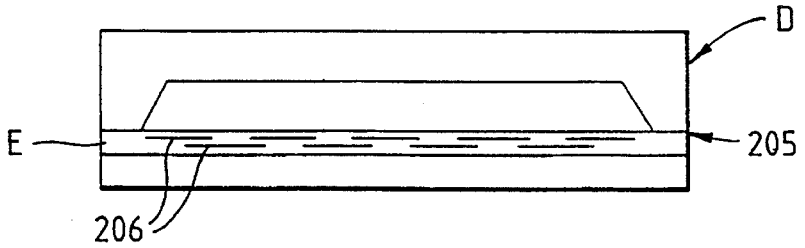

The sheets 201,202,203 are then stacked and diffusion bonded together in the manner detailed in our earlier patent applications, resulting in a bonded stack 205, which is placed in a closed die D as shown schematically in cross-section in FIG. 2B. However, where bond inhibitor has been applied in areas 206, diffusion bonding has not taken place.

Figure 2C:
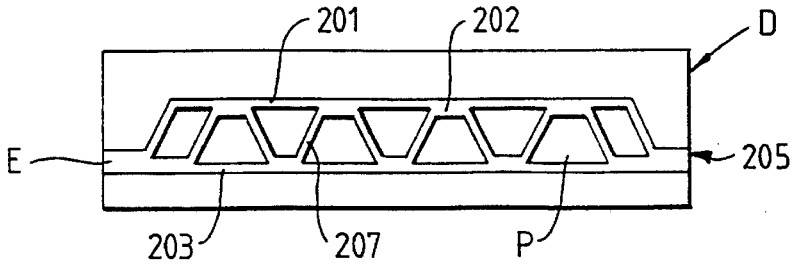

Superplastic forming of the bonded stack 205 into an article which is almost the final shape of the heat exchanger plate element, complete with its internal structure as shown schematically in FIG. 2C, now occurs.

The bonded stack 205 and the die D are heated to superplastic forming temperature and the stack's interior structure, as defined by the pattern of bond inhibitor, is injected with inert gas at high pressure to inflate the stack so that the outer sheets 201,203 move apart against the die forms. As the outer sheet 201 expands superplastically into the die cavity, it pulls the middle or core sheet 202 with it where diffusion bonding has occurred. Superplastic deformation of the core sheet 202 therefore also occurs to form a hollow interior which is partitioned by the stretched portions 207 of the core sheet 202, thereby creating passages P through which a process stream can flow. The edge regions E of the stack 205 remain fully bonded, and therefore flat and unexpanded.

It is convenient for manufacturing purposes if all the sheets 201,202,203 are made of superplastically formable titanium alloy, or other superplastically formable metallic material, though only the sheets 201 and 202 are in fact superplastically formed during manufacture of the element.

After the superplastic forming process has been finished, each article so produced is trimmed around its edges and the manifold holes, indicated by the circles in FIG. 2A, are drilled. When the manifold holes are drilled, they create circular slot openings into those parts of the expanded internal structure which define the inlet I and outlet O. After drilling, the inlet slot I and the outlet slot O are, for the purposes of the present embodiment, completely opened up internally for flow of a single stream of the process fluid by a machining operation to cut away obscuring portions of the core sheet 202. This produces the heat exchanger plate element P1 as further illustrated in FIG. 3, which is ready for incorporation in a matrix of such elements by a diffusion bonding process as mentioned previously.

The plate element shown being produced in FIG. 2 is in fact one of the elements P1 shown in FIG. 1. The other elements P2 are similar to the elements P1 except that their internal core sheet structures are slightly differently arranged for connection of their inlets and outlets to their respective manifolds IM2,OM2. The internal cavities formed in the plate elements P1,P2 during the superplastic forming process are asymmetrically shaped so that the manifold holes for the stream which does not enter the element are drilled though the solid metal formed by diffusion bonding of the edge portions of the sheets. Thus, in FIG. 1, the manifold hole IM1 connects process stream 101 to plate element P1, but not to the immediately preceding and succeeding plate elements P2 in the stack, whereas manifold hole IM2 connects process stream 102 to plate elements P2, but not to plate elements P1.

We suggest the activated diffusion bonding process is used to make the heat exchanger matrix from the plate elements, rather than attempting to solid state diffusion bond adjacent plate elements together in the same way as was done during the manufacture of the plate elements themselves, because of the danger of the individual hollow plate elements collapsing under the higher temperatures and pressures necessary for solid state diffusion bonding without an activator. However, if such collapsing of the elements is not a problem in a specific matrix design, or can be otherwise obviated, it is preferable to utilise solid state diffusion bonding of the plate elements into the matrix, so as to avoid metallurgical differentiation at the bond line, with its attendant corrosion risks if the joint is exposed to a chemically aggressive liquids or gases.

The superplastic forming/diffusion bonding process outlined above results in the production of very accurately formed external surfaces for sheets 201,203, which enable good conformance of each heat exchanger element to its neighbours in a matrix of such elements.

If the manifolds IM1,IM2,OM1,OM2 carry aggressive media as the process streams it will probably be necessary to protect activated diffusion bonded joints between neighbouring plate elements from contact with the aggressive fluid in the manifold means. This can readily be done by making autogenous seal welds which span the joints between the penetrated plate elements.

Figure 3:
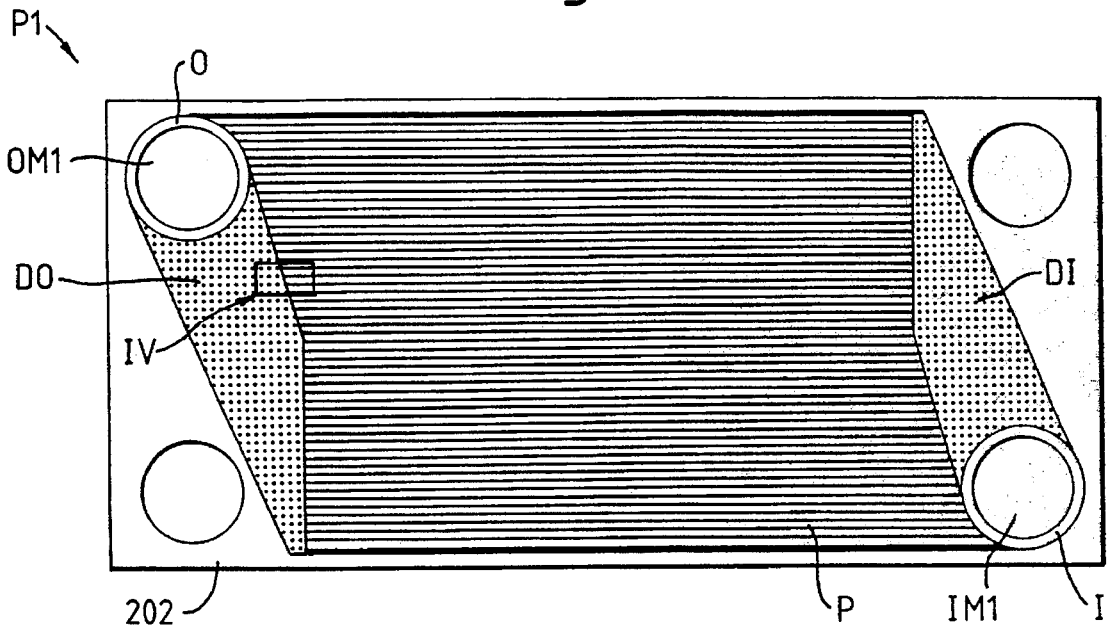
FIG. 3 is a plan view of a heat exchanger plate element suitable for use in the present invention, its top face being removed to show its interior structure.
Figure 4:
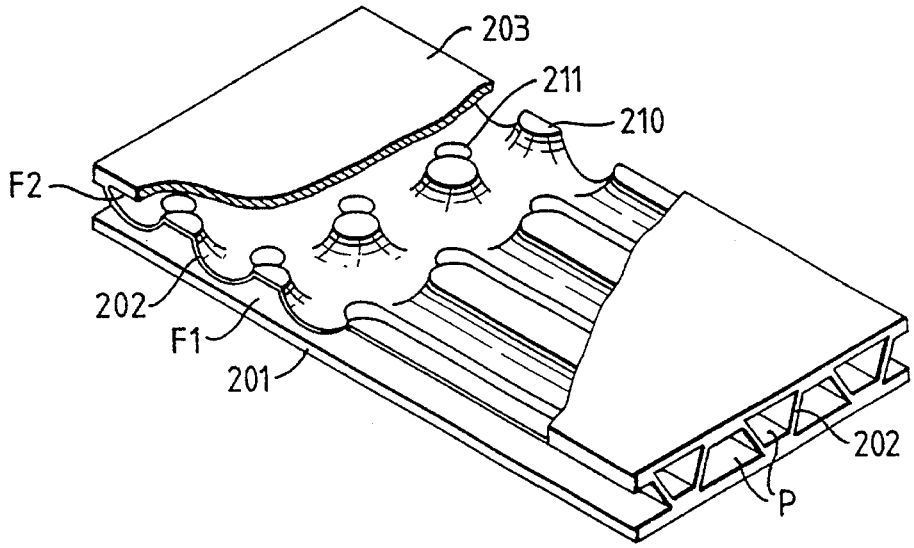
FIG. 4 is a perspective detail view of that part of the heat exchanger plate element in FIG. 3 which is indicated by arrow IV.

Referring now also to FIGS. 3 and 4, the heat exchanger plate element P1 illustrated has a core structure comprising the single core sheet 202. Looking at the features of the heat exchanger plate element P1 in the order in which they would be encountered by a stream of process fluid passing through it, the inlet I is merely a gap between sheets 201 and 203 where the core sheet 202 has been cut away by the above-mentioned machining operation to the extent shown by outer of the concentric circles in FIG. 3. This allows the process fluid to flow on both sides of the core sheet 202 and hence, after traversing the inlet distributor region DI, into all the passages P formed alternately between the core sheet 202 and the outer sheets 201,203.

The inlet I opens directly into the inlet flow distributor region DI, which is a region where the bond inhibitor was not applied to the numerous small circular areas or dots on both the joint faces F1,F2 of the outer sheets (FIG. 2A). These dots are arranged in rows as shown, with each dot on a given joint face F1 being positioned midway between each group of four dots on the other joint face F2. At these dots the core sheet 202 is bonded to the outer sheets 201,203 and during the superplastic forming operation the core sheet 202 is expanded to the double cusped configuration shown in FIG. 4.

The upstanding peaks 210 and depressions 211 thus formed on both sides of the core sheet 202 in the distributor region DI act to diffuse the flow of the process stream so that by the time it has traversed the inlet distributor DI it is distributed over the entire lateral extent of the core structure and enters all the passages P.

The major part of the core structure consists simply of straight line corrugations formed in the core sheet 202. These corrugations are of such a form that, in conjunction with the outer sheets 201,203, longitudinally straight flow passages P with a trapezoid shaped cross-section are defined. As shown in FIG. 4, the transition between the so-called "dot core" distributor regions DI and the "line core" passage region is easily arranged.

When the heat exchange fluid reaches the ends of the passages P which are distant from the inlet distributor DI, it encounters the outlet distributor region DO, also termed the "collector" region. This is a part of the expanded core structure which is of the same form as the inlet distributor DI, and it functions to collect the heat exchange fluid flow from over the lateral extent of the core passages P and to feed it into the outlet manifold OM1 in a way which is distributed around a large proportion of the manifold's periphery.

In the present embodiment, the core structure consists of a single sheet 202, though it could consist of more than one sheet if a more complex core structure is required, as shown in our copending patent application EP90308923.3.

The present embodiment is concerned with a simple heat exchanger plate element in, which one process stream 101 or 102 flows through it on both sides of the core sheet 202 and therefore through all the passages P in the core structure. The process streams 101,102 exchange heat through the intimate thermal contact provided by the bonded joints between neighbouring plate elements. Consequently, the primary heat exchange surfaces are the surfaces of the outer sheets 201,203, whereas the secondary heat exchange surfaces, designated "fins", are the surfaces of the core sheet 202 forming the partitions between the flow passages P.

The person skilled in heat exchanger technology will realise, however, that it would be easy to arrange the inlets, outlets and the core structure of the elements P1,P2 so as to accommodate two process streams, one on each side of the core sheet 202, so that neighbouring flow passages P would carry different streams exchanging heat directly across the partitions between the passages. This would require suitable but easily realised alteration of the form of the expanded core sheet structure to provide the appropriate connections to the inlet and outlet manifolds.

A skilled person will also realise that alternative designs in accordance with the invention can easily be developed to achieve heat exchange between more than two fluids. For example, for each additional fluid, an additional inlet hole and an additional outlet hole can be provided in the end areas of the heat exchanger elements, where the sheets are solid state diffusion bonded together with no internal structure. The elements can then be stacked together to form a heat exchanger matrix giving heat exchange between fluids as desired. For example, with three fluids A, B, C, the sequence of elements within the matrix could be A/B/C/A/B/C, or A/B/B/C/A/B/B/C, or even A/B/C/A/B/B/C, to suit the heat transfer engineer.

It should be realised that the simple geometries shown for the core sheet 202 in the present drawings could readily be altered to produce more conventional finning arrangements, such as herringbone, serrated and perforated, as known in the industry.

Furthermore, for increased efficiency of heat exchange, it may be desirable to dispense with separate passages P formed by corrugations in the core sheet 202. Instead, the core sheet could be formed into the cusped configuration of the distributor regions throughout its whole extent.

Moreover, it is not necessary to have the same size or form of internal structure in all of the elements. These parameters can be chosen to suit the fluid passing through them. Thus with, say, three fluids, the matrix could readily consist of three different types of elements without unduly complicating the manufacture of the matrix.

We claim:

1. A method of manufacturing a heat exchanger for facilitating exchange of heat between at least two process streams, comprising the steps of:

(a) producing a plurality of heat exchange elements, each finished heat exchange element comprising a sandwich structure having two outer sheets and a core sheet structure between the outer sheets, the outer sheets providing side faces of the heat exchange element, said producing step comprising diffusion bonding the sheets of the sandwich structures together in a predetermined bonding pattern and superplastically expanding the sandwich structures where the sheets are not diffusion bonded together to produce superplastically expanded core sheet structures between the outer sheets; and (b) bonding said heat exchange element together over at least most of the areas of their side faces to produce a matrix of heat exchange elements arranged in side-by-side heat exchange relationship, said bonding step effecting intimate thermal contact between adjacent side faces of the heat exchange elements.

2. A method according to claim 1, in which the bonding step effects metallurgically bonded joints between adjacent heat exchange elements.

3. A method according to claim 1, in which the bonding step comprises an activated diffusion bonding step.

4. A method according to any one of claims 1 to 3, in which process stream inlet and outlet manifolds are produced in the matrix by machining holes through the thicknesses of the heat exchange elements to connect the expanded core sheet structures to the holes, the resulting inlet and outlet manifolds penetrating the matrix transversely of the direction of process flow in the heat exchange elements.

* * * * *